US010865808B2

(12) United States Patent
Fakes et al.

(10) Patent No.: US 10,865,808 B2
(45) Date of Patent: Dec. 15, 2020

(54) FAN FOR ROTARY ELECTRICAL MACHINE

(71) Applicant: VALEO EQUIPEMENTS ELECTRIQUES MOTEUR, Creteil (FR)

(72) Inventors: Michel Fakes, Seclin (FR); André Sauvignet, Massy (FR); Erwan Le Goff, Verrieres le Buisson (FR); Laurent Dahine, Ivry sur Seine (FR)

(73) Assignee: Valeo Equipements Electriques Moteur, Creteil (FR)

( * ) Notice: Subject to any disclaimer, the term of this patent is extended or adjusted under 35 U.S.C. 154(b) by 608 days.

(21) Appl. No.: 15/354,823

(22) Filed: Nov. 17, 2016

(65) Prior Publication Data

US 2017/0067474 A1 Mar. 9, 2017

Related U.S. Application Data

(63) Continuation-in-part of application No. 15/310,246, filed as application No. PCT/FR2015/051041 on Apr. 17, 2015, now abandoned.

(30) Foreign Application Priority Data

May 14, 2014 (FR) ..... 14 54286

(51) Int. Cl.
*F04D 29/28* (2006.01)
*F04D 29/66* (2006.01)

(52) U.S. Cl.
CPC ..... *F04D 29/666* (2013.01); *F04D 29/282* (2013.01)

(58) Field of Classification Search
CPC combination set(s) only.
See application file for complete search history.

(56) References Cited

U.S. PATENT DOCUMENTS 5,075,964 A * 12/1991 Galliet ..... B21D 53/267 29/889.23
6,796,405 B2 * 9/2004 Ruiz ..... F16D 65/12 188/264 A (Continued)

FOREIGN PATENT DOCUMENTS

DE 946178 C 7/1956
FR 2743952 A1 7/1997

(Continued)

*Primary Examiner* — Aaron R Eastman
*Assistant Examiner* — Maxime M Adjagbe
(74) *Attorney, Agent, or Firm* — Berenato & White, LLC

(57) ABSTRACT

A fan of a rotary electric machine. The fan has an axis of rotation and comprises a plurality of blades (101). At least one characteristic of the blades is variable in the direction of a circumference of the fan around the axis of rotation for at least four consecutive blades. The at least one characteristic is selected from the group comprising a spacing angle between a straight line passing radially via a characteristic point of one of the blades and the axis of rotation of the fan and a straight line passing via a corresponding characteristic point of an adjacent blade and the axis of rotation of the fan, a height of the blade, a length of the blade, and an angle of inclination between a straight line passing via two characteristic points of a blade, and a straight line passing via two corresponding characteristic points of an adjacent blade.

32 Claims, 8 Drawing Sheets

(56) References Cited

U.S. PATENT DOCUMENTS

| | | | | |
|---|---|---|---|---|
| 7,207,779 | B2 * | 4/2007 | Horng | F04D 29/283 416/186 R |
| 8,803,396 | B2 * | 8/2014 | Vasilescu | F04D 29/667 310/156.66 |
| 2013/0251533 | A1 * | 9/2013 | Hall | F04D 25/024 416/223 R |
| 2014/0225481 | A1 * | 8/2014 | Murphy | H02K 9/06 310/60 R |
| 2014/0286752 | A1 * | 9/2014 | Chiou | F04D 17/16 415/119 |
| 2014/0308118 | A1 * | 10/2014 | Lin | F04D 17/16 415/203 |

FOREIGN PATENT DOCUMENTS

| | | | |
|---|---|---|---|
| FR | 2850805 | A1 | 8/2004 |
| GB | 2057586 | A | 4/1981 |

* cited by examiner

FAN FOR ROTARY ELECTRICAL MACHINE

CROSS-REFERENCE TO RELATED APPLICATIONS AND CLAIM TO PRIORITY

The present application is a Continuation-in-Part of the commonly owned U.S. patent application Ser. No. 15/310,246 filed Nov. 10, 2016, which is a national stage application of International Application No. PCT/FR2015/051041 filed Apr. 17, 2015, which claims priority to French Patent Application No. 1454286 filed May 14, 2014, the disclosures of which are incorporated herein by reference and to which priority is claimed

FIELD OF THE INVENTION

The present invention relates to a fan for a rotary electrical machine, as well as to a vehicle comprising a device of this type.

The present invention applies in particular in the field of motor vehicles, and more particularly to rotary electrical machines such as motors, alternators and alternator-starters.

BACKGROUND OF THE INVENTION

The purpose of fans for rotary electrical machines is to cool the machine. However, since these machines can have speeds of rotation of up to approximately 18,000 revolutions per minute and more, substantial noise can be produced by the mechanism.

In order to avoid the emergence of harmonics, and thus of noise caused by the fan, it is common to position the blades asymmetrically. However, this technique does not guarantee the non-emergence of harmonics. In fact, the environment of the fan can play a part in whether harmonics emerge or not, for example the closeness of another part of the electrical machine.

It is therefore necessary to improve the fans of electrical machines constantly in order to reduce the noise of the mechanism.

SUMMARY OF THE INVENTION

The objective of the present invention is to eliminate some or all of these disadvantages.

For this purpose, according to a first aspect, the invention relates to a fan for a rotary electrical machine comprising at least three blades, wherein at least one characteristic of the blades is, according to the circumference of the fan in a given direction, progressive for at least three consecutive blades, the characteristic being able to be selected from the group comprising:

a spacing angle between a straight line passing via a characteristic point of the blade and an axis of rotation of the fan, and a straight line passing via a corresponding characteristic point of an adjacent blade and the axis of rotation of the fan;

a height of the blade;

a length of the blade; and an angle of inclination between a straight line passing via two characteristic points of blade, and a straight line passing via two corresponding characteristic points of an adjacent blade.

In other words, according to a first alternative, a spacing angle between a straight line passing via a characteristic point of the blade and the axis of rotation of the fan, and a straight line passing via a corresponding characteristic point of an adjacent blade and the axis of rotation of the fan is, according to the circumference of the fan in a given direction, progressive for at least three consecutive blades.

According to a second alternative, the height of the blade is, according to the circumference of the fan in a given direction, progressive for at least three consecutive blades.

According to a third alternative, a length of the blade is, according to the circumference of the fan in a given direction, progressive for at least three consecutive blades.

According to a fourth alternative, an angle of inclination between a straight line passing via two characteristic points of the blade, and a straight line passing via two corresponding characteristic points of an adjacent blade is, according to the circumference of the fan in a given direction, progressive for at least three consecutive blades.

The progressiveness of at least one characteristic for at least three blades makes it possible to limit the emergence of harmonics and reduce the noise of the electrical machine. The effect is all the more noticeable during idling. The comfort of the user is thus increased.

In some embodiments, at least one characteristic of the blades is progressive for all of the blades of the fan.

The advantage of these embodiments is to have progressiveness concerning all the blades of the fan. Thus the emergence of harmonics is reduced.

In some embodiments, the number of blades of the fan which is the subject of the present invention is a prime number.

These embodiments have the advantage of improving the reduction of noises caused by the fan.

In some embodiments, the sum of the spacing angles between the blades is equal to 360°.

The advantage of these embodiments is to have distribution of the blades which can be implemented, and more particularly in the case when the fan comprises two parts comprising blades assembled by welding.

In some embodiments, the smallest distance between two consecutive blades is more than 3 mm.

A minimum distance of 3 mm permits adequate circulation of the air in the machine.

In some embodiments, the minimum length of arc between two blades is more than 3 mm.

These embodiments have the advantage of permitting a minimum distance necessary for displacement of masses of air by the blades of the fan in order to cool the machine.

In some embodiments, the progressiveness of the spacing angles between the blades is defined by a positive function.

A function which governs the progressiveness of the spacing angles has the advantage of defining a method for reproducible calculation of the progressiveness of the angles.

In some embodiments, the function of progressiveness of the spacing angles between the blades is linear.

The advantage of having a linear function is to have an increase in the spacing angles which is augmented regularly, or a decrease in the spacing angles which is reduced regularly.

In some embodiments, the ratio between the largest spacing angle between two blades and the smallest spacing angle between two blades is more than 1.2.

A ratio of this type has the advantage of creating substantial progressiveness of the spacing angles between the blades, thus improving the reduction of noises.

In some embodiments, the progressiveness of the length of the blade is defined by a positive function.

A function which governs the progressiveness of the lengths has the advantage of defining a method for reproducible calculation of the progressiveness of the lengths.

In some embodiments, the function of progressiveness of the length of the blade is linear.

The advantage of having a linear function is to have an increase in the lengths which is augmented regularly, or a decrease in the lengths which is reduced regularly.

In some embodiments, the ratio between the length of the largest blade and the length of the smallest blade is more than 1.2.

These embodiments have the advantage of creating substantial progressiveness between the lengths of the different blades, and improving the reduction of noises.

In some embodiments, the progressiveness of the height of the blade is defined by a positive function.

A function which governs the progressiveness of the heights of the blade has the advantage of defining a method for reproducible calculation of the progressiveness of the heights.

In some embodiments, the function of progressiveness of the height of the blade is linear.

The advantage of having a linear function is to have an increase in the heights which is augmented regularly, or a decrease in the heights which is reduced regularly.

In some embodiments, the ratio between the height of the largest blade and the height of the smallest blade is more than 1.2.

These embodiments have the advantage of creating substantial progressiveness between the lengths of the different blades, and of improving the reduction of noises.

In some embodiments, the progressiveness of the angles of inclination between the blades is defined by a positive function.

A function which governs the progressiveness of the lengths has the advantage of defining a method for reproducible calculation of the progressiveness of the lengths.

In some embodiments, the function of progressiveness of the angles of inclination between the blades is linear.

The advantage of having a linear function is to have an increase in the heights which is augmented regularly, or a decrease in the heights which is reduced regularly.

In some embodiments, the ratio between the largest angle of inclination and the smallest angle of inclination is more than 1.2.

These embodiments have the advantage of creating substantial progressiveness between the lengths of the different blades and improving the reduction of noises.

In some embodiments, at least two characteristics of the blades are progressive.

The advantage of these embodiments is, for some of the blades, to have progressiveness in height, whereas progressiveness of the angles of inclination is applied to others of the blades. Better balancing can thus be obtained.

In some embodiments, the progressiveness of at least one characteristic of the blade depends on the progressiveness of at least one other characteristic of the blade.

These embodiments have the advantage of permitting better distribution of the material if the lengths increase, whereas the heights decrease for example. These embodiments permit better balancing, as well as constancy for example of the surface of the blades which is configured to displace the masses of air homogenously.

In some embodiments, the fan which is the subject of the present invention comprises progressive distribution of material configured to balance the fan according to the progressiveness of at least one characteristic of at least three blades.

Progressive distribution of material makes it possible to balance the fan, whilst being inversely proportional to the distribution of material of the blades for example.

In some embodiments, the progressive distribution of material is carried out by addition of material.

These embodiments have the advantage of balancing the fan irrespective of the number of blades and their forms. In addition, the contact surface between a face of the fan and a face of the magnet wheel is large.

In some embodiments, the addition of material is carried out by depositing material, the quantity of which increases according to the circumference of the fan in a given direction.

Addition of material of this type has the advantage of permitting balanced distribution of the material on the fan.

In some embodiments, the depositing is situated on the periphery of an axial hole in the fan.

These embodiments have the advantage of not increasing the volume of the fan.

In some embodiments, the progressive distribution of material is carried out by removal of material.

The advantage provided by these embodiments is the balancing of the fan, irrespective of the number of blades and their forms. In addition, elimination of material in relation to the fan without balancing by distribution of material is less onerous for example if the elimination of material has been designed to take place during the moulding of the part.

In some embodiments, the production material of at least one part of the fan comprises mostly aluminium.

Since aluminium is a light material, the weight of the rotary electrical machine will be reduced.

In some embodiments, at least one part of the fan is obtained from sheet metal.

Since the cost of machining and purchasing sheet metal is low, the cost of the fan and the rotary electrical machine will be reduced.

In some embodiments, at least one part of the fan is obtained by bending.

The advantage of these embodiments is the speed of the bending and thus the decrease in the production cost of mass-produced fans.

In some embodiments, at least one part of the fan is made of plastic material.

These embodiments have the advantage of having a part made of a light, non-oxidising material.

In some embodiments, at least one part of the fan is obtained by moulding.

The advantage provided by these embodiments is to have a production method which can be adapted to the different embodiments previously described.

In some embodiments, the fan which is the subject of the present invention is obtained by assembling two parts comprising blades.

Assembly of two parts comprising blades has the advantage of obtaining a decrease in the noise and ease of manipulation of the parts during the different production and machining operations.

According to a second aspect, the present invention relates to a vehicle which comprises at least one fan which is the subject of the present invention.

Since the advantages, objectives and particular characteristics of the vehicle which is the subject of the invention are similar to those of the fan which is the subject of the present invention, they will not be described again here.

BRIEF DESCRIPTION OF THE DRAWINGS

Other advantages, objectives and characteristics of the invention will become apparent from the following non-limiting description of at least one particular embodiment of the fan and of the vehicle comprising a fan of this type, in relation to the appended drawings in which.

DETAILED DESCRIPTION OF THE PREFERRED EMBODIMENT(S) OF THE INVENTION

It should hereby be noted that the figures are not to scale.

Figure 1:
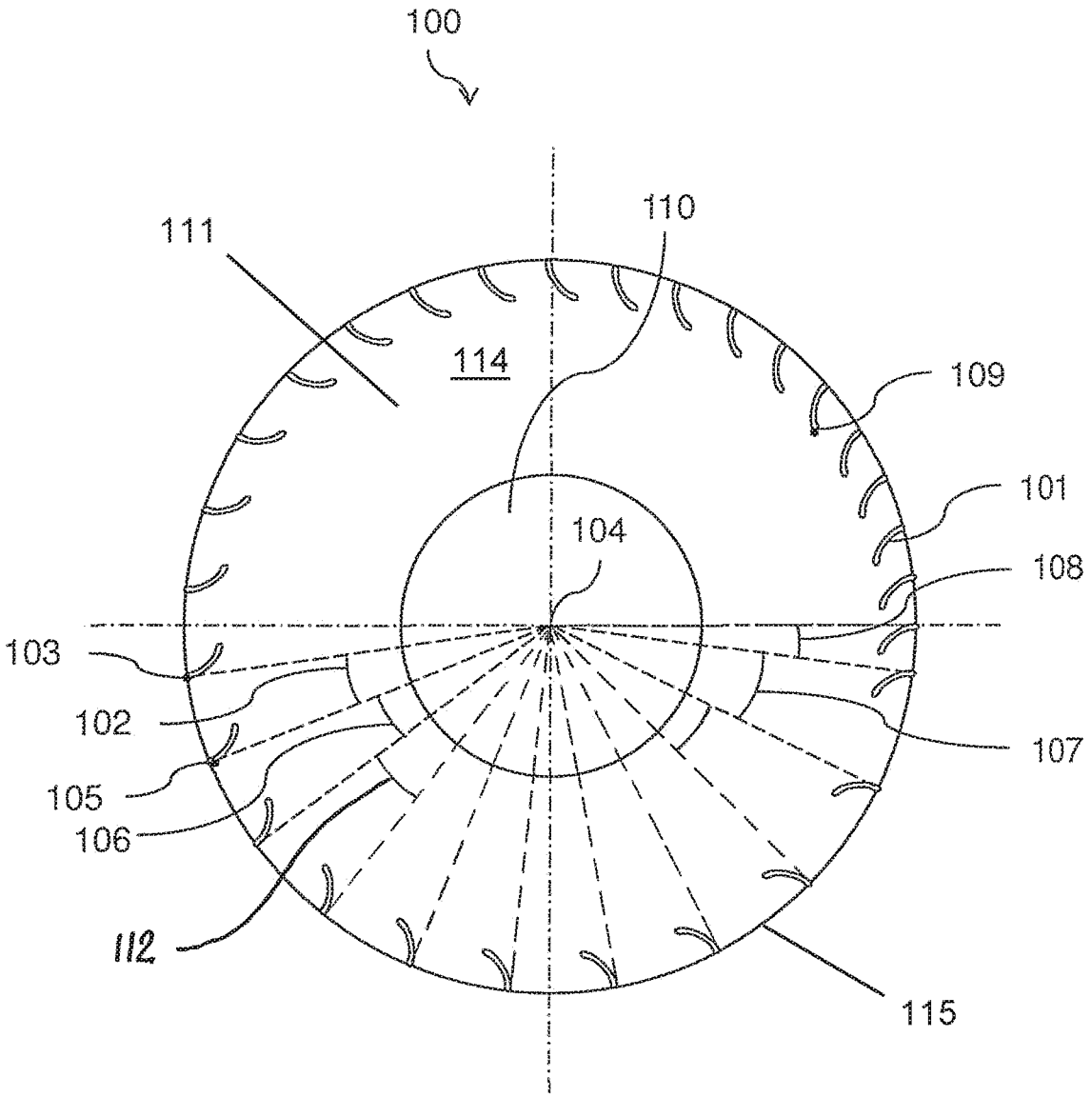
FIG. 1 represents schematically and in plan view a first embodiment of a device which is the subject of the present invention.

FIG. 1 represents a front view of a particular embodiment 100 of a fan which is the subject of the present invention.

The fan 100 has an axis of rotation 104 and comprises a support plate 111 coaxial with the axis of rotation 104 and a plurality of blades 101 non-moveably secured to an axial face 114 of the support plate 111. Preferably, the number of blades 101 is a prime number. The fan 100 can comprise blades arranged perpendicularly to the axial face 114 of the support plate 111. The axial face can comprise an axial hole 110 through the support plate 111 which receives a shaft of a rotor of a rotary electrical machine. The axial face 114 is preferably described by an outer periphery 115 of the support plate 111. In some embodiments, the blades 101 are concave.

In some embodiments, the blades are convex or straight.

Spacing angles between the blades according to the first embodiment of the device 100 are progressively variable, i.e., follow a progressive (or variable) distribution, wherein the spacing angles between the consecutive blades rise in in value, or progress from low to high. In other words, a spacing angle between the consecutive blades 101 is a positive function, for example a positive linear function, of an angular position of the spacing angle around the axis of rotation 104 of the fan 100. A spacing angle 102 is defined between:

- a straight line passing via:
  - a characteristic point 103, known as a radially outer end point of one of the blades (101), which can be the end point of the blade, on the face of the fan 100 comprising the blades 101, and on the outer face of the blade, which point is the furthest from the axis of rotation 104 of the fan 100; and
  - the axis of rotation 104 of the fan; and
- a straight line passing via:
  - a characteristic point 105 on an adjacent blade also defined as a radially outer end point of the adjacent blade; and
  - the axis of rotation 104 of the fan 100.

In some embodiments, the characteristic point can be a point known as the start of blade point. The start of blade point 109 is for example the point of the blade, on a face of the fan comprising the blades, and on the outer face of the blade, which point is closest to the axis of rotation of the fan The progressiveness (or variability, or variation) between the spacing angle 102 and an adjacent spacing angle 106 can be characterized by a positive function. In other words, a value of the spacing angle 106 is bigger than the value of the preceding spacing angle 102. Specifically, the spacing angle between the consecutive blades 101 is the positive function of an angular position of the spacing angle around the axis of rotation. Preferably, this function is linear and has a positive slope. In some embodiments, the slope is greater than 1. Similarly, the variation between the spacing angle 106 and an adjacent spacing angle 112 can be characterized by a positive function. In other words, a value of the spacing angle 112 is bigger than the value of the preceding spacing angle 106. Preferably, this function is also linear and has a positive slope. In some embodiments, the slope is greater than 1.

The progressiveness of the angular distribution of the blades 101 is preferably applied to all the blades. In some embodiments, the progressiveness of the angular distribution is applied to at least four blades. Alternatively, the progressiveness of the angular distribution of the blades 101 is preferably applied to at least half of the blades of the fan, i.e., to a majority of the number of the blades 101 when the number of the blades 101 is an odd number, wherein the progressively variable blades are consecutive blades. Further alternatively, the progressiveness of the angular distribution of the blades is preferably applied to at least 80% of the blades of the fan.

The angular distribution of the blades is such that the sum of the spacing angles between the corresponding characteristic points is equal to 360°.

The ratio between the smallest spacing angle 108 and the largest spacing angle 107 is preferably more than 1.2.

Preferably, the minimum length of arc between two blades is more than 3 mm. For example, the smallest distance between two consecutive blades is more than 3 mm. The length of arc can be calculated between two end of blade points and two adjacent blades between which the spacing angle is the smallest spacing angle 108.

Figure 2:
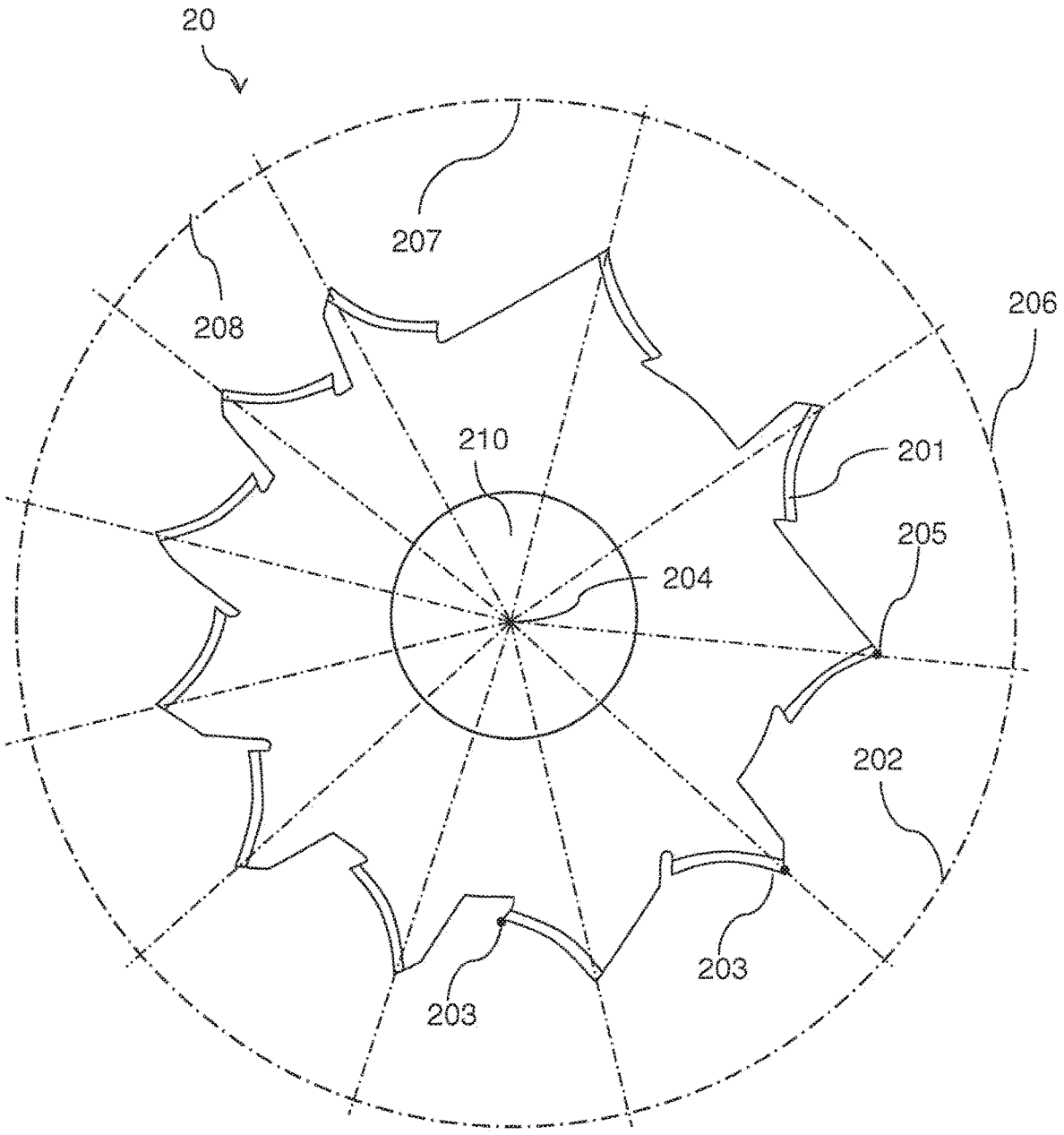
FIG. 2 represents schematically and in plan view a second embodiment of a device which is the subject of the present invention.

FIG. 2 shows a front view of an embodiment 20 of a fan which is the subject of the present invention.

The device comprises blades 201. Preferably, the number of blades 201 is a prime number. The device can comprise blades which are arranged perpendicularly to a face. The face can comprise an axial hole 210 which receives a shaft of a rotor of a rotary electrical machine. The face is preferably described by an outer diameter. The spaces between the blades can be empty of material, and create teeth on which the blades are located.

In some embodiments, the blades 201 are concave. In some embodiments, the blades are convex or straight.

Spacing angles between the blades can follow a progressive distribution. A spacing angle 202 can be defined between:

- a straight line passing via:
  - a characteristic point 203, known as the end of blade point, which can be the point of the blade, on the face of the fan comprising the blades, and on the outer face of the blade, which point is the furthest from the axis of rotation of the fan; and
  - the axis of rotation 204 of the fan;
- a straight line passing via:
  - a characteristic point 205 on an adjacent blade also characterised as being an end of blade point; and
  - the axis of rotation 204 of the fan.

In some embodiments, the characteristic point can be a point known as the start of blade point. The start of blade point 209 is for example the point of the blade, on a face of the fan comprising the blades, and on the outer face of the blade, which point is closest to the axis of rotation of the fan.

The progressiveness between a spacing angle 202 and an adjacent spacing angle 206 can be characterised by a positive function. Preferably, this function is linear and has a strictly positive slope. In some embodiments, the slope is strictly greater than 1.

The progressiveness of the angular distribution of the blades is preferably applied to all the blades. In some embodiments, the progressiveness of the angular distribution is applied to at least three blades.

The angular distribution of the blades is such that the sum of the spacing angles between corresponding characteristic points is equal to 360°.

The ratio between the smallest spacing angle 208 and the largest spacing angle 207 is preferably more than 1.2.

Preferably, the minimum length of arc between two blades is more than 3 mm, and the smallest distance between two consecutive blades is more than 3 mm. The length of arc can be calculated between two end of blade points of two adjacent blades between which the spacing angle is the smallest spacing angle 208.

Figure 3:
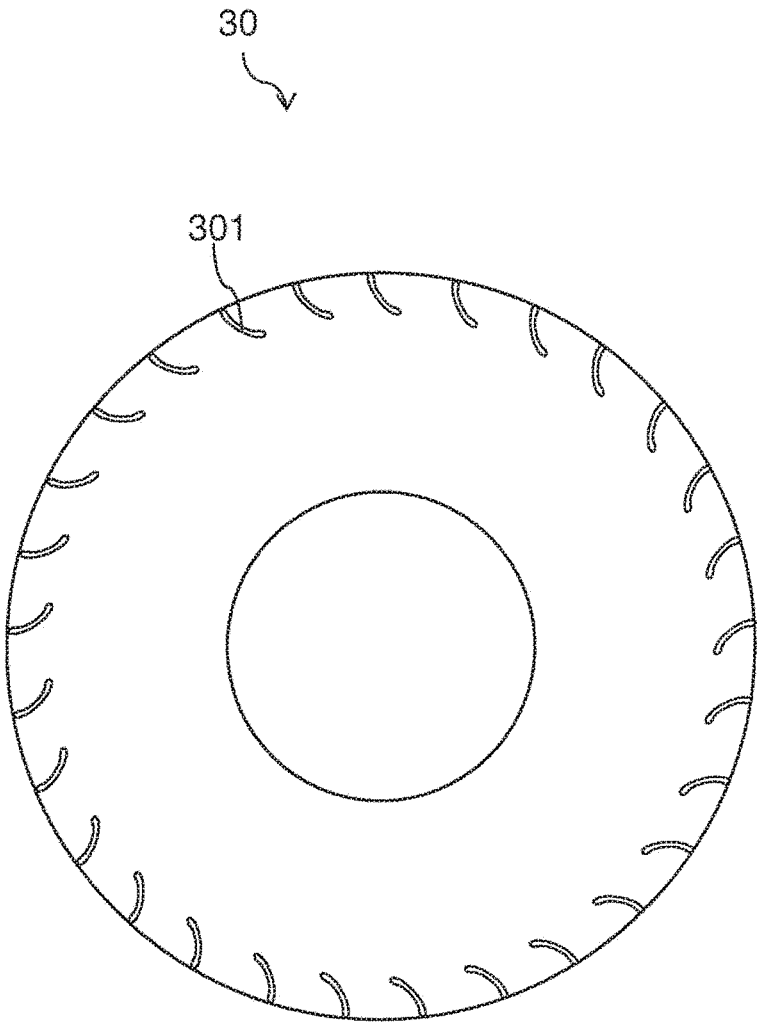
FIG. 3 represents schematically and in perspective an embodiment of a symmetrical fan.

FIG. 3 shows a front view of a particular embodiment 30 of a fan with symmetrical distribution of blades.

The fan 30 comprises blades 301. The blades 301 can be placed perpendicularly to a face, and the distribution of the blades can be symmetrical as far as the spacing angle is concerned. The blades are all similar, i.e. they have the same length, the same height and the same angle of inclination. The blades 301 can be concave or convex.

Figure 4:
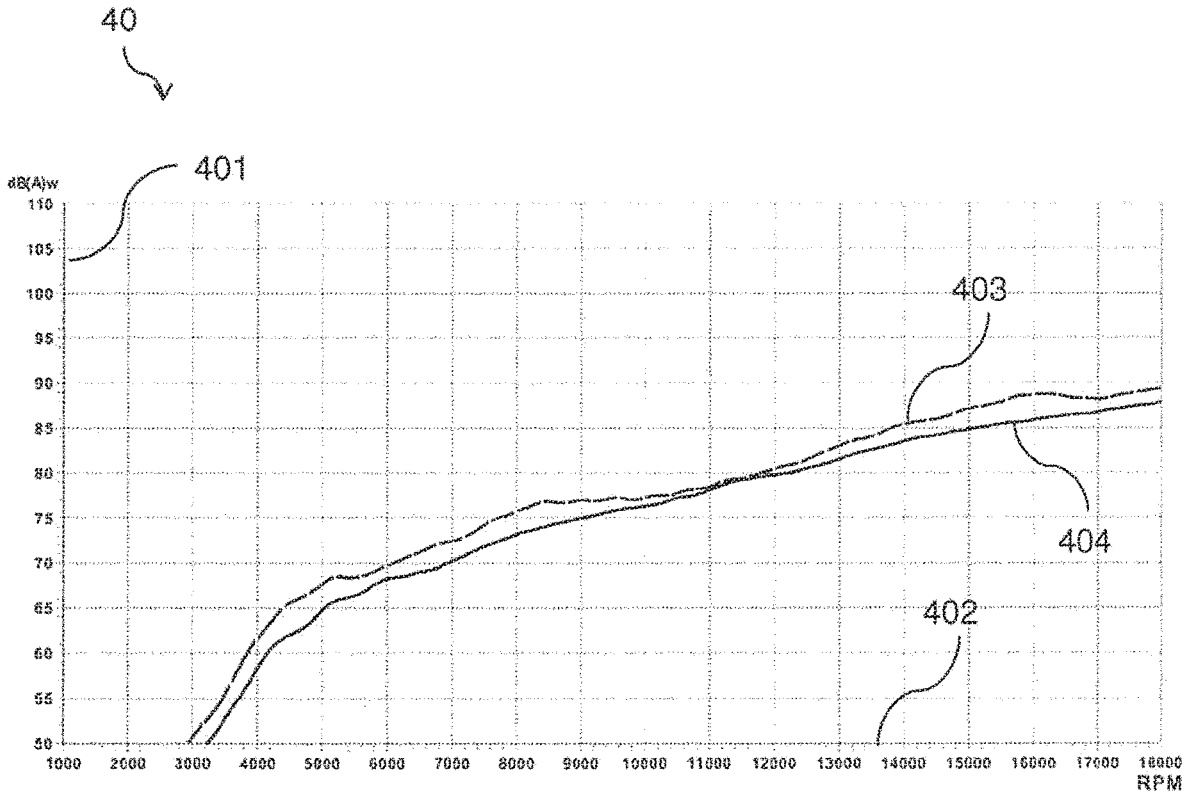
FIG. 4 represents schematically a graph which is representative of a harmonic of order twenty nine generated by an embodiment of a symmetrical fan and an embodiment of a fan which is the subject of the present invention.

FIG. 4 shows a graph 40 which is representative of the amplitude of a harmonic of order twenty nine generated by an embodiment of a symmetrical fan 30 and of the amplitude of a harmonic of order twenty nine generated by an embodiment 100 of a fan which is the subject of the present invention.

The graph 40 has on the X-axis 401 the speed of rotation in revolutions per minute (RPM) of the fan. The Y-axis 402 is a weighted acoustic power measurement A in decibel watts (the acronym of which is dB(A)W) of the amplitude of a signal, and more particularly a sound signal.

The curve 403 represents the amplitude of the harmonic of order twenty nine of a symmetrical fan 30 for rotations between 0 and 18,000 revolutions per minute. The curve 404 represents the amplitude of the harmonic of order twenty nine of an embodiment 100 of a fan which is the subject of the present invention for rotations between 0 and 18,000 revolutions per minute.

The curves 403 and 404 have been obtained by the inventors from tests.

It can be observed that the curve 403 is at all points higher than the curve 404. The difference in amplitude between the curve 403 and the curve 404 is more than 3 dB(A)W at certain points of the curve. The curves 403 and 404 are strictly increasing. The maximum reached by the curve 403 in the measurement range is close to 90 dB(A)W, and the maximum reached by the curve 404 in the measurement range is close to 88 dB(A)W.

The curve 403 is lower than 50 dB(A)W from 0 to approximately 2900 revolutions per minute. The curve 404 is lower than 50 dB(A)W from 0 to approximately 3200 revolutions per minute.

The harmonic of order twenty nine caused by the rotation of a symmetrical fan 30 thus occurs earlier, and produces more noise than the harmonic of order twenty nine caused by the rotation of a symmetrical fan 100.

Figure 5:
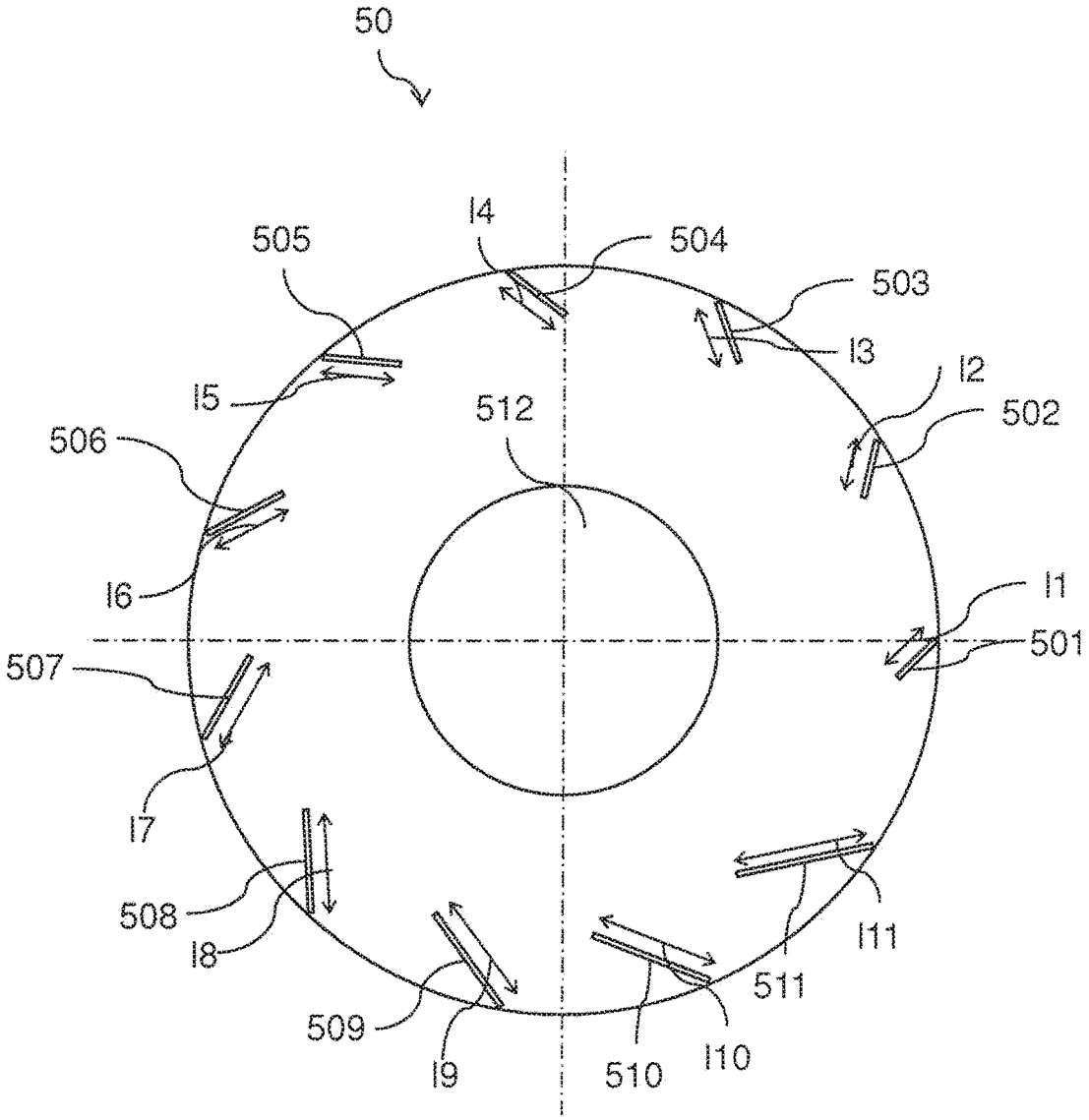
FIG. 5 represents schematically and in plan view a third embodiment of a device which is the subject of the present invention.

FIG. 5 shows a front view of a particular embodiment 50 of a fan which is the subject of the present invention.

The device comprises blades 501. Preferably, the number of blades 501 is a prime number. The device can comprise blades which are arranged perpendicularly to a face. The face can comprise an axial hole 512 which receives a shaft of a rotor of a rotary electrical machine. The face is preferably described by an outer diameter. The blades 501 can be straight.

In some embodiments, the blades are convex or concave.

The length of the blade can be defined as being the length of the curve of intersection between the outer face of the blade and the face of the fan comprising the blades. For example, the lengths l1, l2, l3, l4, l5, l6, l7, l8, l9, l10 and l11 of the blades 501 to 511 respectively are such that l1 is smaller than l2, which is smaller than l3 and so on, the longest length being l11.

The progressiveness between the length l1 of a blade 501 and the length l2 of a blade 502 can be characterised by a positive function. Preferably, this function is linear and has a strictly positive slope. In some embodiments, the slope is strictly greater than 1. The ratio between the length l11 of the largest blade 511 and the length l1 of the smallest blade 501 is more than 1.2.

The progressiveness of the length of the blades is preferably applied to all the blades. In some embodiments, the progressiveness of the length of the blades is applied to at least three blades. The blades have the same height for example.

Preferably, the minimum length of arc between two blades is more than 3 mm. For example, the smallest distance between two consecutive blades is more than 3 mm. The length of arc can be calculated between two ends of blade points of two adjacent blades.

Figure 6:
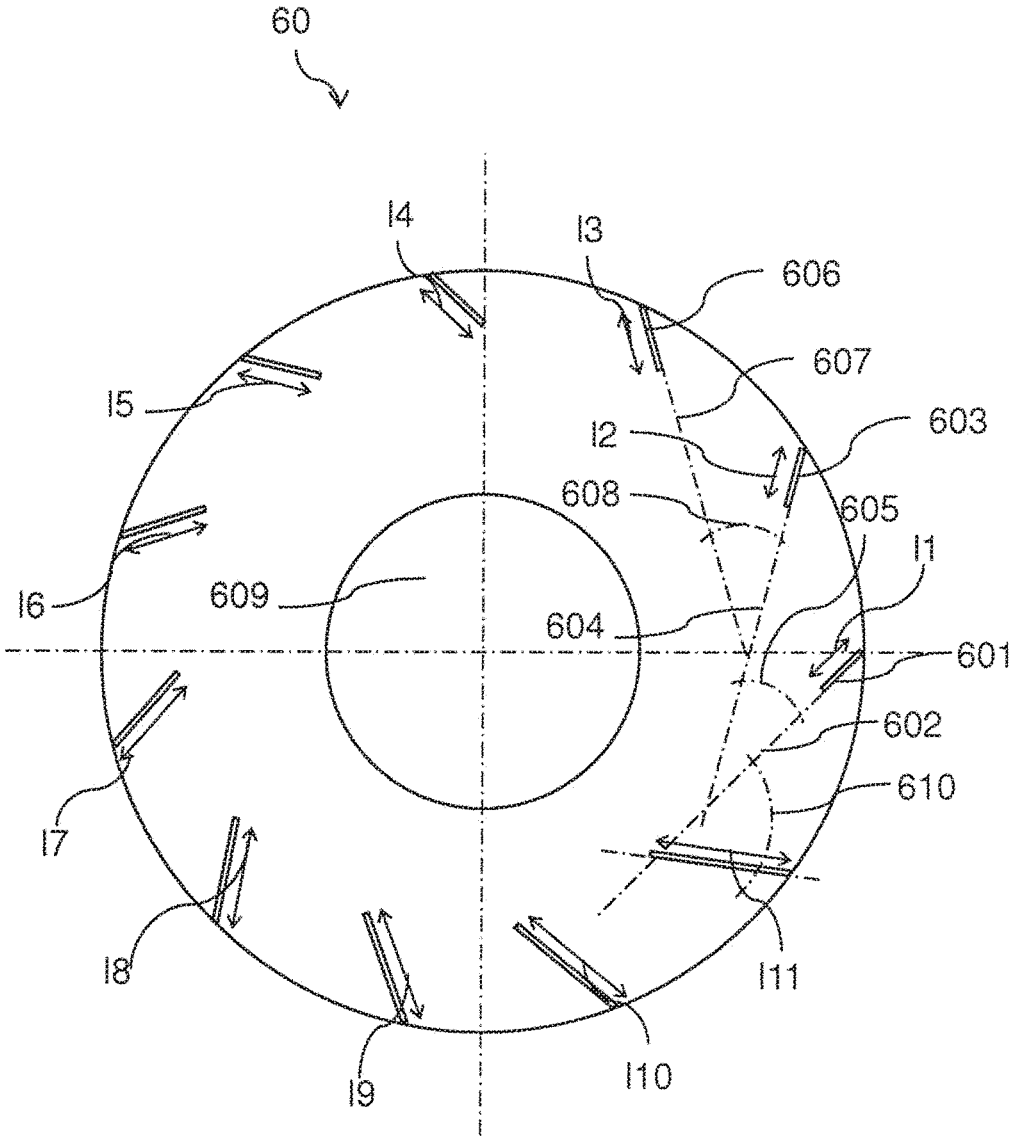
FIG. 6 represents schematically and in perspective a fourth embodiment of a device which is the subject of the present invention.

FIG. 6 shows a front view of a particular embodiment 60 of a fan which is the subject of the present invention.

The device comprises blades 601. Preferably, the number of blades 601 is a prime number. The device can comprise blades which are arranged perpendicularly to a face. The face can comprise an axial hole 609 which receives a shaft of a rotor of a rotary electrical machine. The face can preferably be described by an outer diameter. The blades 601 can be straight.

In some embodiments, the blades are convex or concave.

The length of the blade can be defined as being the length of the curve of intersection between the outer face of the blade and the face of the fan comprising the blades. For example, the lengths l1, l2, l3, l4, l5, l6, l7, l8, l9, l10 and l11 of the blades are such that that l1 is smaller than l2, which is smaller than l3 and so on, the longest length being l11.

The progressiveness between the length l1 of a blade 601 and the length l2 of a blade 603 can be characterised by a positive function. Preferably, this function is linear and has a strictly positive slope. In some embodiments, the slope is strictly greater than 1. The ratio between the length l11 of the largest blade and the length l1 of the smallest blade can be more than 1.2.

The progressiveness of the length of the blades is preferably applied to all the blades. In some embodiments, the progressiveness of the length of the blades is applied to at least three blades. The blades have the same height for example.

Angles of inclination between the blades can follow a progressive distribution. An angle of inclination 605 can be defined between:

- a straight line 602 passing via:
  - a characteristic point, known as the end of blade point, which can be the point of the blade, on the face of the fan comprising the blades, and on the outer face of the blade, which point is the furthest from the axis of rotation of the fan; and
  - the axis of rotation of the fan; and
  - a characteristic point known as the start of blade point, which can be the point of the blade, on the face of the fan comprising the blades, and on the outer face of the blade, which point is the closest to the axis of rotation of the fan:
- a straight line 604 which passes via the corresponding characteristic points on the adjacent blade.

The progressiveness between an angle of inclination 605 and an adjacent angle of inclination 608 can be characterised by a positive function. Preferably, this function is linear and has a strictly positive slope. In some embodiments, the slope is strictly greater than 1.

The progressiveness of the angular inclination of the blades is preferably applied to all the blades. In some embodiments, the progressiveness of the angular inclination is applied to at least three blades.

The ratio between the smallest angle of inclination 605 and the largest angle of inclination 610 is preferably more than 1.2.

In some embodiments, the progressiveness of the angles of inclination and the progressiveness of the lengths are connected by a function.

Preferably, the minimum length of arc between two blades is more than 3 mm. For example, the smallest distance between two consecutive blades is more than 3 mm. The length of arc can be calculated between two end of blade points of two adjacent blades.

Figure 7:
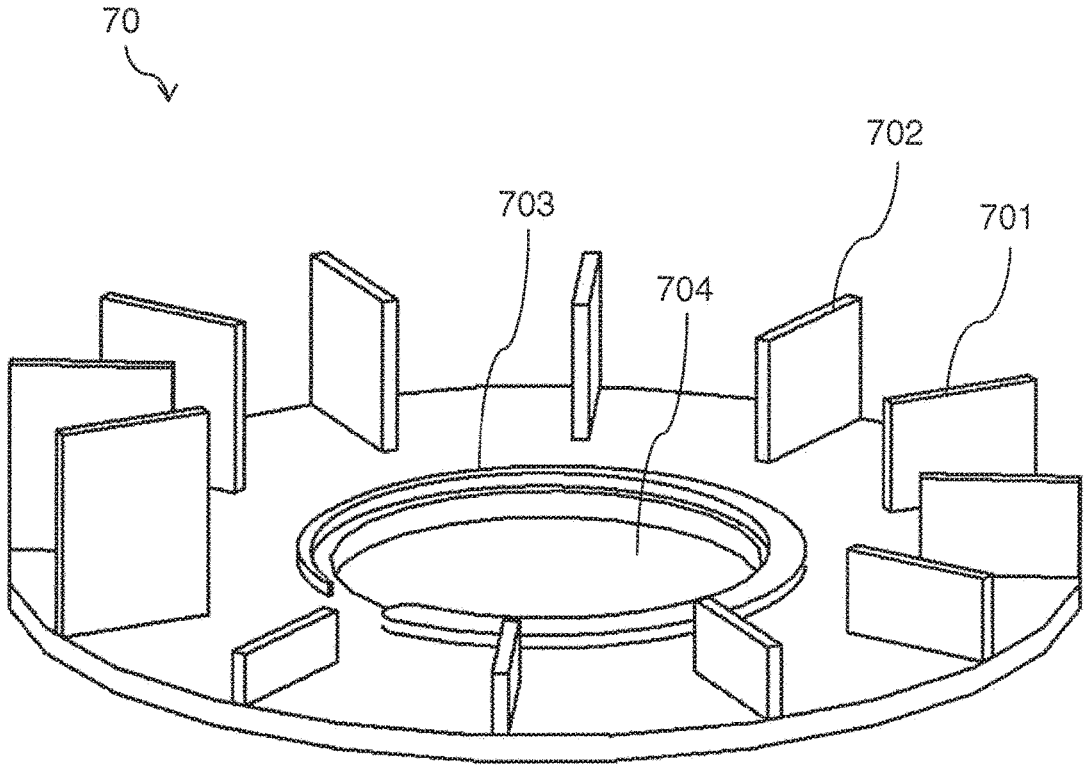
FIG. 7 represents schematically and in perspective a fifth embodiment of a device which is the subject of the present invention.

FIG. 7 shows a view in perspective of a particular embodiment 70 of a fan which is the subject of the present invention.

The device comprises blades 701. Preferably, the number of blades is a prime number. The device can comprise blades which are arranged perpendicularly to a face. The face can comprise an axial hole 704 which receives a shaft of the rotor of a rotary electrical machine. The face is preferably described by an outer diameter. The blades 701 can be straight.

In some embodiments, the blades are convex or concave.

The height of the blade can be defined as being a dimension taken perpendicularly to the face comprising the blades, between the face comprising the blades and the point of the blade which is furthest from the face comprising the blades.

The progressiveness between the height of a blade 701 and the height of a blade 702 can be characterised by a positive function. Preferably, this function is linear and has a strictly positive slope. In some embodiments, the slope is strictly greater than 1. The ratio between the height of the largest blade and the height of the smallest blade can be more than 1.2.

The progressiveness of the height of the blades is preferably applied to all the blades. In some embodiments, the progressiveness of the height of the blades is applied to at least three blades.

Preferably, the minimum length of arc between two blades is more than 3 mm. For example the smallest distance between two consecutive blades is more than 3 mm. The length of arc can be calculated between two end of blade points of two adjacent blades.

The face comprising the blades can comprise a progressive distribution of material 703 configured to balance the fan according to the progressiveness of the heights.

Preferably, the progressive distribution of material is carried out by addition of material in comparison with a fan according to an embodiment 70 without progressive distribution of material. The progressive addition of material can be carried out at the moment of production of the part. The addition of material can be a deposit of material, the quantity of which increases according to the circumference of the fan in a given direction. The addition of material can be localised on the periphery of an axial hole in the fan.

In some embodiments, the progressive distribution of material by addition of material is localised on the face of the fan parallel to the face comprising the blades.

In some embodiments, the progressive distribution of material is carried out by removal of material.

Figure 8:
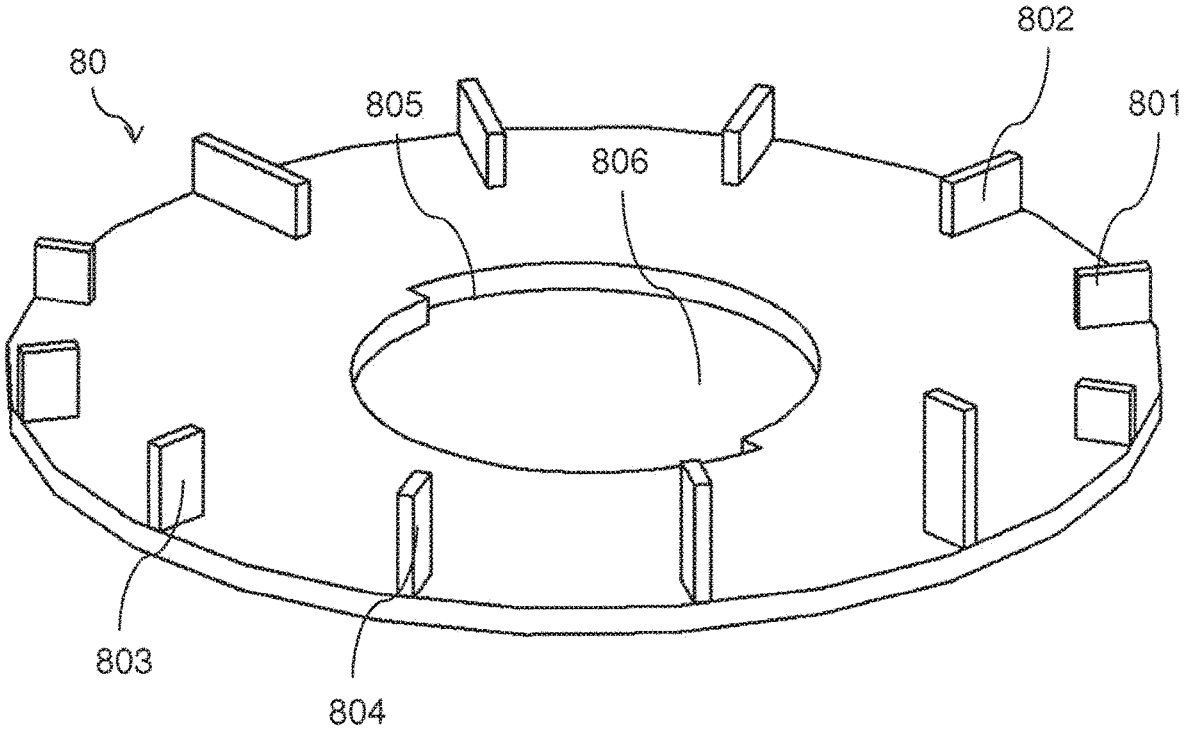
FIG. 8 represents schematically and in perspective a sixth embodiment of a device which is the subject of the present invention.

FIG. 8 shows a view in perspective of a particular embodiment 80 of a fan which is the subject of the present invention.

The embodiment 80 can comprise progressiveness of height for at least three blades and progressiveness of length for at least three other blades. Preferably, the progressiveness is applied to adjacent blades.

In some embodiments, groups of at least three blades can:

- have progressiveness of the spacing angles;
- have progressiveness of the height;
- have progressiveness of the length;
- have progressiveness of the angles of inclination;
- have a combination of progressivenesses of at least two progressivenesses from out of the three preceding ones; or
- not have any progressiveness.

In some embodiments, two groups of at least three different blades have the same progressiveness from amongst the choices listed in the preceding paragraph. The characteristics of the progressiveness can be identical or different.

Preferably, the spacing angle as defined as being between:

- a straight line passing via:
  - a characteristic point, known as the end of blade point, which can be the point of the blade, on the face of the fan comprising the blades, and on the outer face of the blade, which point is the furthest from the axis of rotation of the fan; and
  - the axis of rotation of the fan;
- a straight line passing via:
  - a characteristic point on an adjacent blade also characterised as being an end of blade point; and
  - the axis of rotation of the fan.

Preferably, the angle of inclination is defined as being between:

a straight line passing via:

a characteristic point, known as the end of blade point, which can be the point of the blade, on the face of the fan comprising the blades, and on the outer face of the blade, which point is the furthest from the axis of rotation of the fan; and the axis of rotation of the fan; and a characteristic point, known as the start of blade point, which can be the point of the blade, on the face of the fan comprising the blades, and on the outer face of the blade, which point is closest to the axis of rotation of the fan;

a straight line passing via the corresponding characteristic points on the adjacent blade.

The device comprises blades 801. Preferably, the number of blades is a prime number. The device can comprise blades which are arranged perpendicularly to a face. The face can comprise an axial hole 806 which receives a shaft of a rotor of a rotary electrical machine. The face is preferably described by an outer diameter. The blades 801 can be straight.

In some embodiments the blades are convex or concave.

Some of the blades can have progressiveness in height, and others of the blades can have progressiveness in length.

The progressiveness between the length of a blade 801 and the length of a blade 802 can be characterised by a positive function. Preferably, this function is linear, and has a strictly positive slope. In some embodiments the slope is strictly greater than 1. The ratio between the length of the largest blade and the length of the smallest blade can be more than 1.2.

In some embodiments, the progressiveness of the length of the blades is applied to at least three blades. The blades to which the progressiveness of length is applied have the same height for example.

The progressiveness between the height of a blade 803 and the height of a blade 804 can be characterised by a positive function. Preferably, this function is linear and has a strictly positive slope. In some embodiments, the slope is strictly greater than 1. The ratio between the height of the highest blade and the height of the lowest blade can be more than 1.2.

In some embodiments, the progressiveness of the height of the blades is applied to at least three blades. The blades to which the progressiveness of height is applied have the same length for example.

Preferably, the minimum length of arc between two blades is more than 3 mm. For example, the smallest distance between two consecutive blades is more than 3 mm. The length of arc can be calculated between two end of blade points of two adjacent blades.

The face comprising the blades can comprise progressive distribution of material 805 configured to balance the fan according to the progressiveness of the heights and the lengths.

Preferably, the progressive distribution of material is carried out by removal of material relative to a fan according to an embodiment 80 without progressive distribution of material. The progressive removal of material can be carried out at the moment of production of the part or during a subsequent machining operation.

In some embodiments, at least two characteristics are progressive and are selected from the group comprising:

the spacing angle;

the length;

the height;

the angle of inclination.

Figure 9:
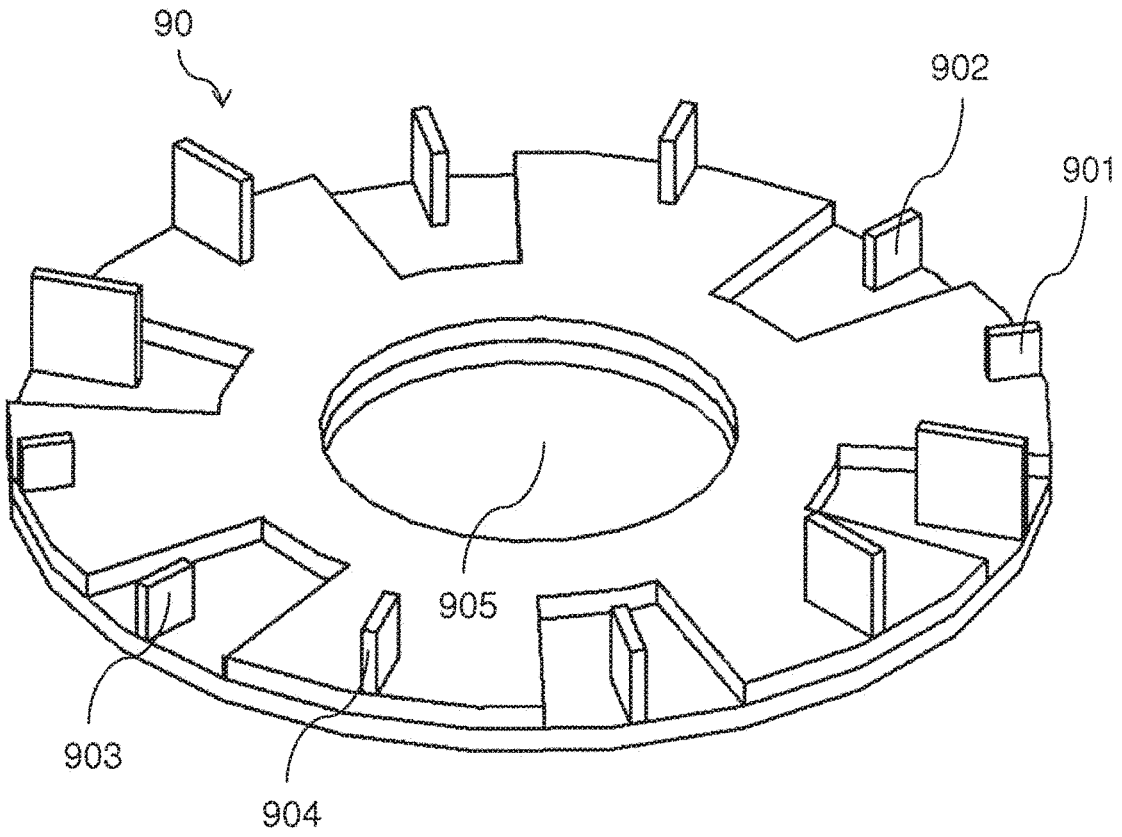
FIG. 9 represents schematically and in perspective a seventh embodiment of a device which is the subject of the present invention.

FIG. 9 shows a view in perspective of a particular embodiment 90 of a fan which is the subject of the present invention.

The embodiment 90 can comprise progressiveness of height and length for at least three blades. The progressiveness of height can depend on the progressiveness of length. For example, the height can vary proportionally to the length.

In some embodiments, the double progressiveness is applied to all the blades. In some embodiments, at least two characteristics are progressive and the characteristics of the progressivenesses are connected by a function. The characteristics which can be progressive are:

the spacing angles;

the length;

the height;

the angles of inclination.

Preferably, the spacing angle is defined as being between:

a straight line passing via:

a characteristic point known as the end of blade point, which can be the point of the blade, on the face of the fan comprising the blades, and on the outer face of the blade, which point is furthest from the axis of rotation of the fan; and the axis of rotation of the fan;

a straight line passing via:

a characteristic point on an adjacent blade also characterised as being an end of blade point; and the axis of rotation of the fan.

Preferably, the angle of inclination is defined as being between:

a straight line passing via:

a characteristic point known as the end of blade point, which can be the point of the blade, on the face of the fan comprising the blades, and on the outer face of the blade, which point is furthest from the axis of rotation of the fan; and a characteristic point, known as the start of blade point, which can be the point of the blade, on the face of the fan comprising the blades, and on the outer face of the blade, which is point closest to the axis of rotation of the fan;

a straight line passing via the corresponding characteristic points on the adjacent blade.

In some embodiments, at least two groups of at least three different blades can have the same progressiveness. The characteristics of the progressiveness can be identical or different.

In some embodiments, some of the blades can have progressiveness with a plurality of characteristics, and others of the blades can have progressiveness with a different plurality of characteristics.

The embodiment 90 comprises two assembled parts 903 and 904. Preferably, the assembly is carried out by welding. The part 903 can comprise blades 901. The part 904 can comprise blades 902. Preferably, the number of blades of the device is a prime number. For example, the sum of the number of blades 901 and the number of blades 902 is a prime number.

The device can comprise blades which are arranged perpendicularly to a face. The face can comprise an axial hole 905 which receives a shaft of a rotor of a rotary electrical machine. The face can preferably be described by an outer diameter. The blades 901 and 902 can be straight.

In some embodiments, the blades are convex or concave.

The progressivenesses of the device can be characterised by positive functions. Preferably, these functions are linear and have strictly positive slopes. In some embodiments, the slopes are strictly greater than 1. The ratio between the characteristic of the largest blade and the characteristic of the smallest blade can be more than 1.2.

Preferably, the minimum length of arc between two blades is more than 3 mm. For example, the smallest distance between two consecutive blades is more than 3 mm. The length of arc can be calculated between two end of blade points of two adjacent blades.

The face comprising the blades can comprise a progressive distribution of material configured to balance the fan according to the progressiveness of the heights and the lengths.

In some embodiments, the progressiveness of the blades can be independent from the direction of rotation of the fan.

The aforementioned embodiments can be:

made of material comprising mostly aluminium and obtained by bending;

made of material comprising mostly aluminium and obtained by moulding;

made of metal plate and obtained by bending; or made of plastic material and obtained by moulding.

The aforementioned embodiments can be obtained by assembling two parts comprising blades. The two parts can be:

made of material comprising mostly aluminium and obtained by bending;

made of material comprising mostly aluminium and obtained by moulding;

made of metal plate and obtained by bending; or made of plastic material and obtained by moulding.

Preferably, the two parts have the same material and the same production mode.

Figure 10:
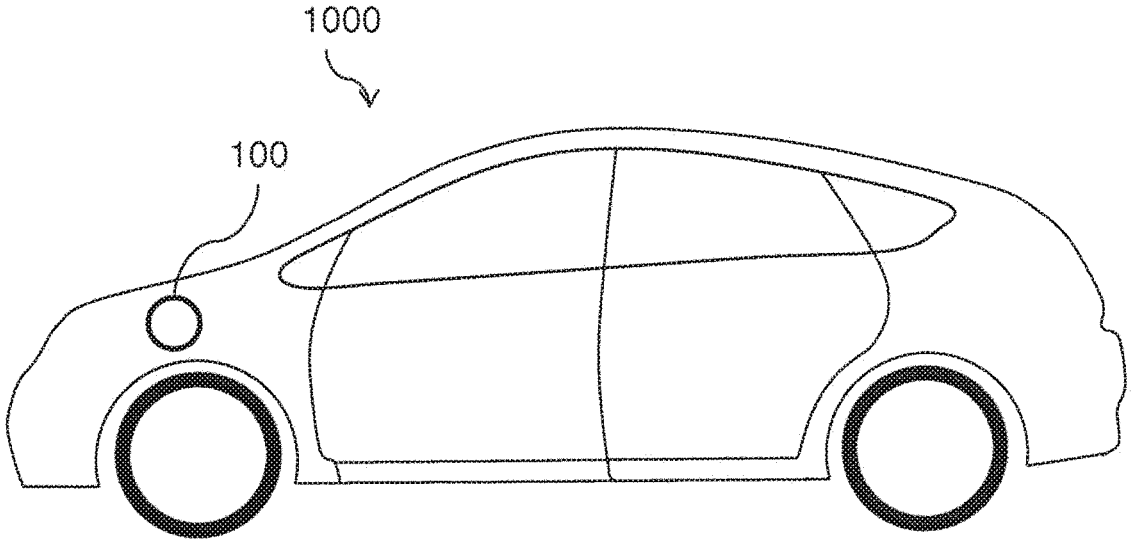
FIG. 10 represents schematically and in plan view a vehicle which is the subject of the present invention.

FIG. 10 shows a particular embodiment of the vehicle 1000 which is the subject of the present invention.

The vehicle 1000 can comprise a rotary electrical machine such as a motor, an alternator or an alternator-starter which comprises at least one fan 100. In some embodiments, the vehicle 1000 comprises an embodiment 20, 50, 60, 70, 80, 90, or any other embodiment previously cited of the fan which is the subject of the present invention. Preferably, the vehicle comprises two fans from amongst the embodiments previously cited. The two fans can be identical.

The invention claimed is:

1. A fan (100) for a rotary electrical machine, the fan having an axis of rotation and comprising a support plate coaxial with the axis of rotation and blades (101) non-moveably secured to an axial face of the support plate, a number of the blades (101) being a prime number, at least one characteristic of the blades is progressively variable in the direction of a circumference of the fan around the axis of rotation for a majority of the blades, the progressively variable blades being consecutive blades, the at least one characteristic selected from the group consisting of:

a spacing angle (102) between a straight line passing radially via a characteristic point (103) of one of the blades and the axis of rotation of the fan (104) and a straight line passing via the characteristic point (105) of other of the blades adjacent to the one of the blades and the axis of rotation of the fan, wherein the characteristic point of each of the blades is a radially outer end point of each of the blades (101) furthest from the axis of rotation and disposed on the axial face of the support plate within an outer periphery of the support plate;

a height of each of the majority of the blades;

a length of each of the majority of the blades; and an angle of inclination (605) between a straight line (602) passing via two characteristic points of one of the blades, and a straight line (604) passing via two characteristic points of other of the blades adjacent to the one of the blades, wherein the two characteristic points of each of the blades are a radially outer end point of each of the blades furthest from the axis of rotation and a radially inner end point of each of the blades closest to the axis of rotation, both the radially outer and inner end points disposed on the axial face of the support plate within an outer periphery of the support plate.

2. The fan (100) according to claim 1, wherein the at least one characteristic of the blades (101) is progressively variable for all of the blades of the fan.

3. The fan (100) according to claim 1, wherein a sum of the spacing angles (102) between the blades (101) is equal to 360°.

4. The fan (100) according to claim 3, wherein the spacing angle (102) between the blades (101) consecutive to one another varies linearly around the axis of rotation as a linear function of an angular position of the spacing angle around the axis of rotation.

5. The fan (100) according to claim 1, wherein the smallest distance between two of the blades (101) consecutive to one another is more than 3 mm.

6. The fan (100) according to claim 1, wherein a minimum length of arc between two of the blades (101) is more than 3 mm.

7. The fan (100) according to one of claim 1, wherein the spacing angle (102) between the blades (101) consecutive to one another is defined by a positive function.

8. The fan (100) according to claim 7, wherein a ratio between a largest spacing angle (107) and a smallest spacing angle (108) is more than 1.2.

9. The fan (50) according to claim 1, wherein the length (l1) of each of the blades (501) is defined by a positive function.

10. The fan (50) according to claim 9, wherein the lengths (l1) of the blades (501) is a linear function of an angular position of each of the blades (501) around the axis of rotation.

11. The fan (50) according to claim 9, wherein a ratio between the length (l11) of a largest blade (511) and the length (l1) of a smallest blade (501) is more than 1.2.

12. The fan (60) according to claim 1, wherein the at least one characteristic of the blades is the angle of inclination (605) between the blades (601) consecutive to one another, and wherein the angles of inclination (605) between the blades (601) consecutive to one another are defined by a positive function of an angular position of the each of the blades around the axis of rotation.

13. The fan (60) according to claim 12, wherein the angles of inclination (605) between the blades (601) consecutive to one another are defined by a linear function of an angular position of each of the blades around the axis of rotation.

14. The fan (70) according to claim 13, wherein the height of one of the blades (701) is defined by a linear function of an angular position of the blade around the axis of rotation.

15. The fan (60) according to claim 12, wherein a ratio between a largest angle of inclination (610) and a smallest angle of inclination (605) is more than 1.2.

16. The fan (70) according to claim 1, wherein the height of each of the blades (701) is defined by a positive function of an angular position of the blade around the axis of rotation.

17. The fan (70) according to claim 16, wherein a ratio between the height of a largest blade (701) and the height of a smallest blade is more than 1.2.

18. The fan (80) according to claim 1, wherein at least two characteristics of the blades (801) are variable in the direction of the circumference of the fan around the axis of rotation for the majority of the total number of the blades.

19. The fan (90) according to claim 18, wherein variation of the at least one characteristic of the blades (901) depends on the variation of at least one other characteristic of the blades.

20. The fan (100) according to claim 1, wherein material of at least one part of the fan comprises aluminum.

21. The fan (100) according to claim 20, wherein at least one part of the fan is obtained by bending.

22. The fan (100) according to claim 20, wherein at least one part of the fan is obtained by moulding.

23. The fan (100) according to claim 1, wherein at least one part of the fan is obtained from sheet metal.

24. The fan (100) according to claim 1, wherein at least one part of the fan is made of plastic material.

25. The fan (90) according to claim 1, obtained by assembling at least two parts (903 and 904) comprising the blades.

26. A vehicle (1000) comprising at least one fan (100) according to claim 1.

27. The fan (100) according to claim 1, wherein the at least one characteristic of the blades (101) is variable for at least 80% of the blades of the fan.

28. A fan (70) for a rotary electrical machine, the fan having an axis of rotation and comprising:

a plurality of blades (101), and a variable distribution of material (703) configured to balance the fan according to variation of at least one characteristic of at least four consecutive blades (701) of the plurality of blades, the at least one characteristic of the at least four consecutive blades is variable in the direction of a circumference of the fan around the axis of rotation for the at least four consecutive blades of the plurality of blades, the at least one characteristic selected from the group consisting of:

a spacing angle (102) between a straight line passing radially via a characteristic point (103) of one of the plurality of blades and the axis of rotation of the fan (104) and a straight line passing via the characteristic point (105) of other of the plurality of blades adjacent to the one of the plurality of blades and the axis of rotation of the fan, wherein the characteristic point of each of the plurality of blades is a radially outer end point of each of the plurality of blades (101) furthest from the axis of rotation;

a height of each of the at least four consecutive blades;

a length of each of the at least four consecutive blades; and an angle of inclination (605) between a straight line (602) passing via two characteristic points of one of the plurality of blades, and a straight line (604) passing via two characteristic points of other of the plurality of blades adjacent to the one of the plurality of blades, wherein the two characteristic points of each of the plurality of blades are a radially outer end point of each of the plurality of blades furthest from the axis of rotation and a radially inner end point of each of the plurality of blades closest to the axis of rotation.

29. The fan (70) according to claim 28, wherein the variable distribution of material (703) is carried out by addition of material.

30. The fan (70) according to claim 29, wherein the addition of material (703) is carried out by depositing material, the quantity of which increases according to the circumference of the fan in a given direction.

31. The fan (70) according to claim 30, wherein the depositing material (703) is situated on a periphery of an axial hole (704) in the fan.

32. The fan (80) according to claim 28, wherein the variable distribution of material (805) is carried out by removal of material.

* * * * *